United States Patent [19]

Foresman et al.

[11] Patent Number: 5,046,193

[45] Date of Patent: Sep. 10, 1991

[54] AQUATIC THERMAL HEAD COVERING

[76] Inventors: Timothy W. Foresman; Joyce L. Foresman, both of 342 Moreno Ct., Henderson, Nev. 89014

[21] Appl. No.: 473,629

[22] Filed: Feb. 19, 1990

[51] Int. Cl.[5] ..... A42B 1/12

[52] U.S. Cl. ..... 2/68; 2/189; 2/423; 2/425; 2/DIG. 11

[58] Field of Search ..... 2/68, 171, 189, 410, 2/423, 425

[56] References Cited

U.S. PATENT DOCUMENTS

| | | | |
|---|---|---|---|
| 2,105,956 | 1/1938 | Schnaittacher | 2/68 |
| 3,274,612 | 9/1966 | Merriam | 2/3 |
| 3,503,076 | 9/1966 | Marks | 2/68 |
| 3,594,815 | 7/1971 | Reese | 2/425 |
| 3,953,892 | 5/1976 | Kennedy et al. | 2/3 R |
| 3,979,777 | 9/1976 | Gregg | 2/68 |
| 4,281,417 | 8/1981 | Valentine | 2/68 |
| 4,365,354 | 12/1982 | Sullivan | 2/DIG. 11 |
| 4,612,672 | 9/1986 | Schrack | 2/68 |

FOREIGN PATENT DOCUMENTS

| | | | |
|---|---|---|---|
| 100292 | 2/1937 | Australia | 2/68 |
| 60921 | 3/1943 | Denmark | 2/189 |
| 935697 | 10/1955 | Fed. Rep. of Germany | 2/423 |
| 1214768 | 4/1960 | France | 2/423 |
| 361473 | 11/1931 | United Kingdom | 2/68 |

*Primary Examiner*—Werner H. Schroeder
*Assistant Examiner*—Diana L. Biefeld
*Attorney, Agent, or Firm*—Philip D. Junkins

[57] ABSTRACT

An aquatic thermal head covering providing conservation of body heat when worn in or on water, constructed of flexible closed-cell rubber in water-resistant fabric conforming to curvature of wearer's head, with an adjustable brim, chin straps, and component ear flaps of same materials, all secured by cement adhesive bonding, secure stitching, and use of hook and loop material. Head covering affords high visibility in or on water through colors of material and fabric used in construction of cap as well as through application of solas grade reflective tape. Head covering contains a grommet and washer threaded with a cord suitable for attaching cap to a personal flotation device, a wetsuit, or other gear.

8 Claims, 2 Drawing Sheets

AQUATIC THERMAL HEAD COVERING

BACKGROUND

1. Field of Invention

The present invention relates to an aquatic thermal head covering of the type providing thermal protection and ear protection for the wearer as well as being floatable, lightweight, snugly fitting, and making the wearer highly visible in aquatic activities and water sports such as boardsailing, surfing, and boating.

2. Description of Prior Art

Aquatic sports such as boardsailing, surfing, canoeing, sailing, and boating involve activities where the participant may be separated from his or her craft, leaving the body exposed to the water for an extended period. The person separated from the craft is in danger of losing body heat through the extremities and becoming hypothermic. A highly visible thermal waterproof head covering worn by the participant will delay the onset of hypothermia and aid rescuers in locating the wearer in the water.

U.S. Pat. Nos. 4,612,672; 4,281,417; 3,979,777; 3,953,892; 3,503,076; and 3,274,612 have been issued for various designs for bathing caps/helmets, but these aforementioned patents are non-related to this present invention.

U.S. Pat. No. 4,612,672, Schrack (1986), is a floatable protective sports headgear providing ear and eye protection; however, it has no thermal properties and does not enhance visibility of the wearer when mostly submerged in water.

U.S. Pat. No. 4,281,417, Valentine (1981), is an inflatable waterproof bathing cap, but it does not provide thermal properties. This cap can be punctured by a sharp object and become useless.

U.S. Pat. No. 3,979,777, Gregg (1976), is a swim helmet that provides ear protection with an added chamber. Its chin strap is detachable and therefore could become separated from the helmet and render the helmet useless.

U.S. Pat. No. 3,953,892, Kennedy et al (1976), is a safety swim cap but does not have thermal properties, ear protection, nor high visibility. This swim cap is inflatable and could be punctured. The chin strap has a buckle arrangement and could injure the wearer should a mishap occur.

U.S. Pat. No. 3,503,076, Marks (1970), is a swimming cap with rigid dome. This cap, being rigid, offers the wearer protection to his or her hair style, not protection to the ears, nor does it offer thermal properties.

U.S. Pat. No. 3,274,612, Merriam (1966), is a helmet for water sports with air chambers for circulation of water. It offers no thermal properties and is made from fiberglass. The fiberglass makes this helmet cumbersome on the wearer's head.

OBJECTS AND ADVANTAGES

The invention presented here provides a head covering which assures thermal and ear protection to the wearer, the cap consisting of a closed-cell, fabric covered, rubber material capable of conforming to the curvature of the head.

Accordingly, objects and advantages of our invention are:

(a) to provide a degree of thermal control regulated by the adjustable brim (5). When the ear flaps (4*a* and 4*b*) are secured atop the head covering (1), the wearer has the least amount of thermal protection. The thermal properties and ear protection are increased when the ear flaps (4*a* and 4*b*) are secured beneath the wearer's chin. This is for moderate protection. For the greatest thermal protection, the brim (5) is pulled completely down to provide protection to the wearer's neck and add thermal properties and ear protection to the wearer;

(b) to provide a visual aid to be seen by other aquatic sports participants or a rescuer. The advantages are achieved using highly visible colors, e.g., international orange, hot pink, red, etc., and with the addition of solas grade reflective tape;

(c) to provide the advantage of a drainage source for any accumulation of water in the brim by means of a brass grommet and washer;

(d) to provide a nylon cord/leash for the advantage of attaching to the wearer's wetsuit/drysuit or personal flotation devices, assuring that the head covering will not be separated from the wearer; and (e) to provide a means of bailing water from the wearer's craft, the advantage being not to necessitate an extra piece of equipment aboard a small craft.

Still further objects and advantages will become apparent from a consideration of the ensuing description and drawings.

BRIEF DESCRIPTION OF THE DRAWING FIGURES

FIG. 1 is a perspective front view of the head covering of the invention;

FIG. 2 is a top view of the head covering;

FIG. 3 is a perspective rear view of the head covering;

FIG. 4 is a rear elevation view;

FIG. 5 is an alternative embodiment of the ear flap of the head covering of the invention; and FIG. 6 is an enlarged partial sectional view of the brim of the head covering taken on line 6—6 of FIG. 4.

Figure 6:
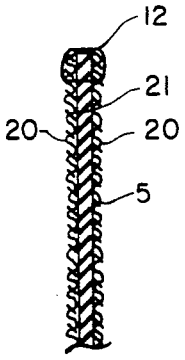

Provided in the head covering 1 are a center panel 2, a pair of side panels 3*a* and 3*b*, a pair of ear flaps 4*a* and 4*b*, a pair of chin straps 7*a* and 7*b*, a brim 5, and a drainage hole 9. The head covering 1 is made from closed-cell neoprene, rubber, or the like as shown in FIG. 6. The inner closed-cell core material 21 is sandwiched between outer layers of waterproof fabric material 20.

Figure 1:
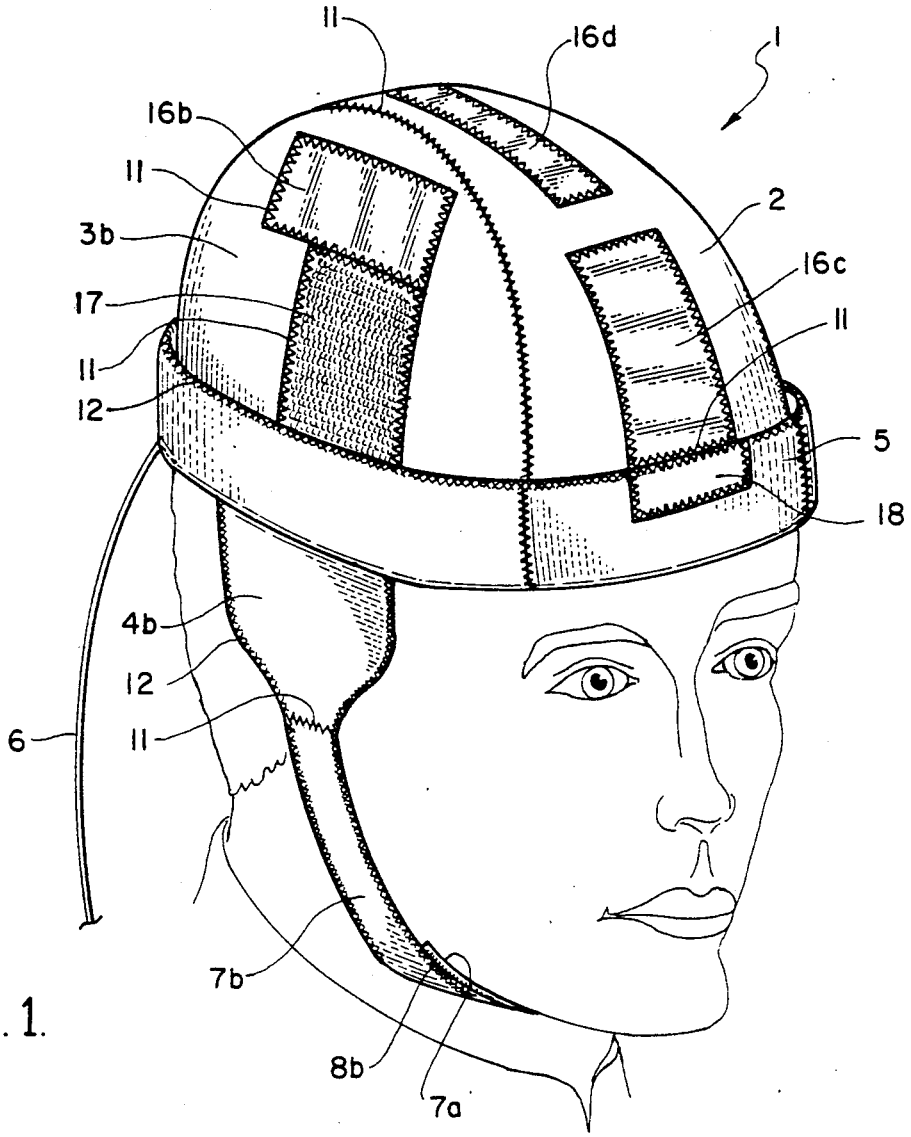
FIGS. 1, 2, 3, and 4 illustrate the present invention, a thermal head covering especially designed for use in aquatic activities, designated generally as 1.
Figure 2:
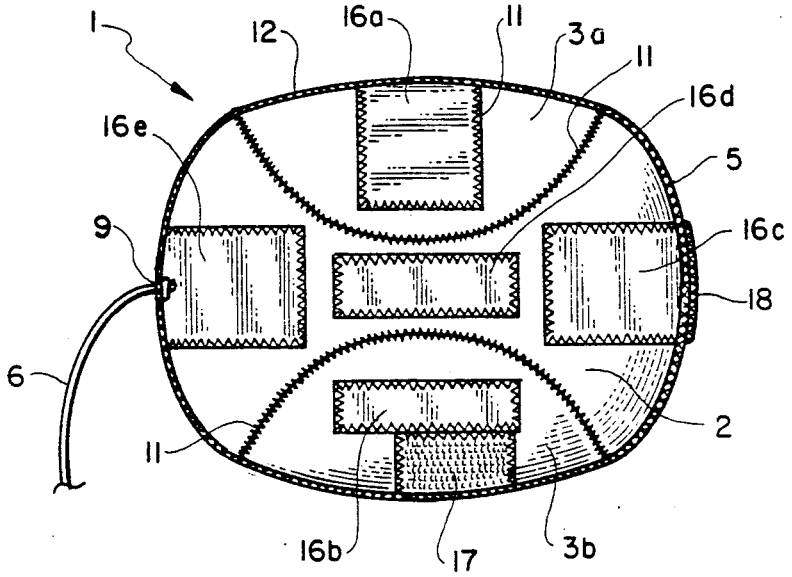

Referring to FIGS. 1 and 2, the chin straps 7*a* and 7*b* are the lower extension of ear flaps 4*a* and 4*b*. The chin straps 7*a* and 7*b* are formed by attaching hook material 8*a* to the outside of chin strap 7*a* and loop material 8*b* to the inside of chin strap 7*b*. As will be seen in FIG. 2, the hook and loop material 8*a* and 8*b* extends from the end of the chin straps 7*a* and 7*b* up to a predetermined distance. The width of chin straps 7*a* and 7*b* is proportional to the width of the hook and loop material 8*a* and 8*b*. Attachment of the hook and loop material 8*a* and 8*b* is accomplished by securing the uppermost end of hook and loop material 8*a* and 8*b* to chin straps 7*a* and 7*b* by sewing width-wise 11, then encasing the hook and loop material 8*a* and 8*b* with an overlock stitch 12 around the ear flaps 4*a* and 4*b* and chin straps 7*a* and 7*b*. The ear flaps 4*a* and 4*b* are positioned on side panels 3*a* and 3*b* so as to cover the wearer's ears when head covering 1 is worn. The ear flaps 4a and 4b are positioned toward the back of side panels 3a and 3b at a predetermined distance from the edge. The ear flaps 4a and 4b are then secured to side panels 3a and 3b by stitching 11 (see FIG. 4).

FIG. 2 illustrates the curved edge portions of side panels 3a and 3b and center panel 2. These curved portions are covered with rubber adhesive or the like. The side panels 3a and 3b with the ear flaps 4a and 4b attached are positioned on both sides of center panel 2, so that the ear flaps 4a and 4b are facing inward and toward the back. The side panels 3a and 3b are then bonded to center panel 2. When the adhesive is dry, a secure stitching 11 binds the side panels 3a and 3b to center panel 2 at the newly formed seams.

Figure 4:
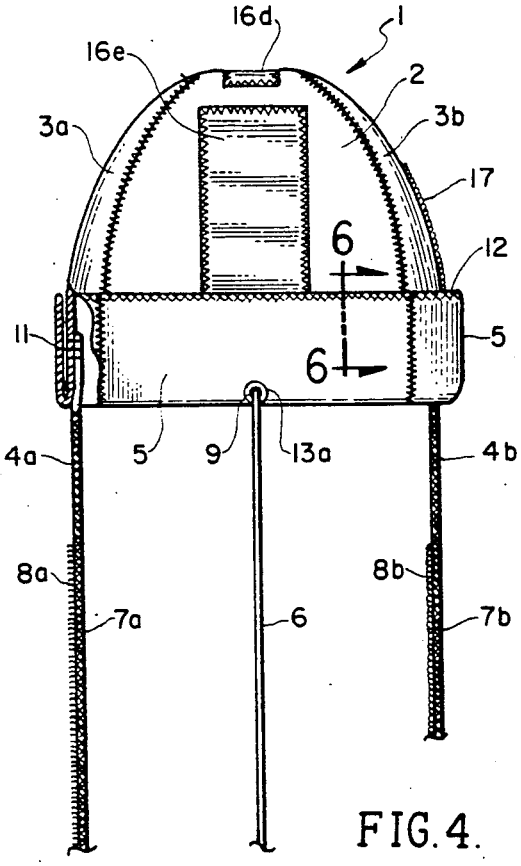
Figure 5:
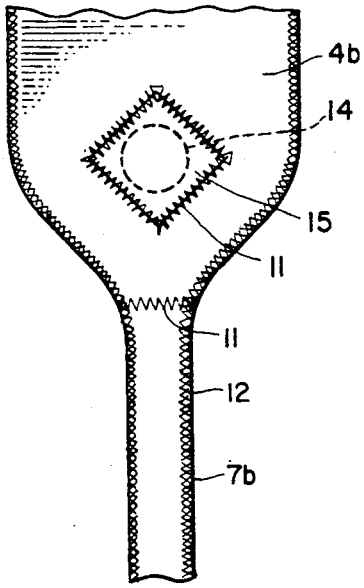

As determined by the position of the ear flaps 4a and 4b, the head covering 1 has a back and front. In the lower portion of the back center panel 2 of head covering 1, a drainage hole 9 of predetermined diameter is made at a predetermined position. FIG. 4 shows the drainage hole 9 encased by a grommet 13a and washer 13b (not shown) made from materials suitable for long-term water exposure, which is bonded to center panel 2 by means of cement adhesive such as Elmer's Heavy Grip Cement, Bordon, Inc., Columbus, Ohio. Cord 6 is then put through the encased drainage hole 9 and secured by knotting the ends or by other means.

After the above mentioned steps are performed and referring back to FIG. 1, the lower straight edge of head covering 1 is encased with an overlock stitch 12. Then the brim 5 is formed by folding the lower quarter portion of head covering 1 upward on the outside of head covering 1.

FIG. 1 shows the brim 5 secured at the center of the front center panel 2 with stitching 11. An alternate means of securing brim 5 to head covering 1 is to secure by stitching 11 a label 18 to the lower front straight edge of center panel 2, then stitching 11 along the top of the label 18 when brim 5 has been formed.

While a preferred embodiment and suggested alternative embodiments of the present invention are described above, it is contemplated that still other changes may be made thereto without departing from the spirit and scope of the present invention. An example as seen in FIGS. 1, 2, 3, and 4 is the addition of reflective material such as solas grade reflective tape to head covering 1. The reflective tape 16a, 16b, 16c, 16d, and 16e is of predetermined size and shape and is secured by stitching 11. The reflective tape 16a, 16b, 16c, 16d, and 16e is so placed that each side panel 3a and 3b has a piece of reflective material 16a and 16b.

Figure 3:
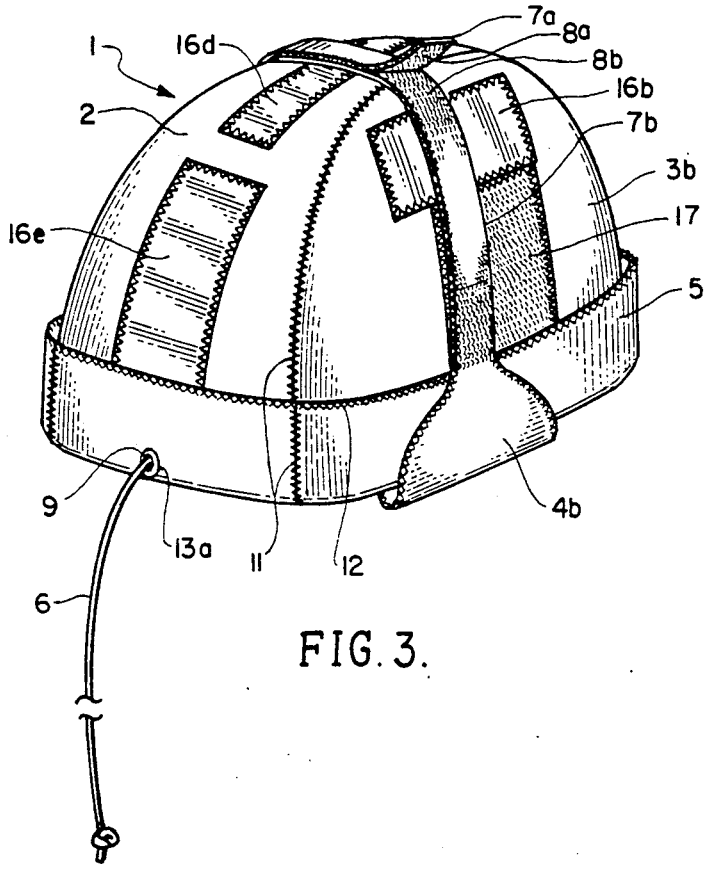

The center panel 2 has reflective tape 16c centered on the front, 16d centered on the crown, and 16e centered on the back as seen in FIGS. 2 and 3.

A further addition as shown in FIGS. 1, 2 and 3 is a patch of predetermined size and shape of wide loop material 17 secured by stitching 11 to side panel 3a or 3b, preferably below the reflective tape 16a or 16b. The function of the wide loop material 17 is to hold a strobe light or other flashlight type with hook fabric facility (not shown) to the wearer's head covering 1, to reflect the light off the reflective material 16a or 16b.

For another example, shown in FIG. 10, an auditory portal 14 could be developed on the side of ear flaps 4a and 4b to facilitate hearing for the wearer. The auditory portal 14 could be developed by making a hole of predetermined size in each ear flap 4a and 4b. The auditory portal 14 would be covered by a piece of water-resistant material 15 on the interior and exterior of ear flap 4a and 4b. The water-resistant material 15 would be secured to ear flaps 4a and 4b by stitching 11.

As illustrated in FIG. 1 the manner of using head covering 1 is to put it on wearer's head. The chin straps 7a and 7b are centered, then fastened below the wearer's chin. If the wearer so desires, the chin straps 7a and 7b may be fastened in the back or top of the head covering 1 as seen in FIG. 3.

The wearer has the option of having the brim 5 folded up as in FIG. 1 or unfolded. Having the brim 5 unfolded adds additional ear coverage and provides warmth to the wearer's neck.

The secure stitching 11 in the center panel 2 on the front in FIG. 1 assures the wearer that the brim 5 will not come down over the wearer's eyes and obstruct the wearer's vision.

As illustrated in FIG. 3, the drainage hole 9 encased by grommet 13a and washer 13b (not shown) allow water, accumulated in brim 5 when in the folded position, to drain out.

The function of cord 6, as illustrated in FIGS. 1, 2, 3, and 4, is to allow attachment of one end of the cord to another piece of equipment to prevent its loss and for easy access when a head covering is required or desired.

FIG. 6 shows, in an enlarged partial sectional view taken on line 6—6 of FIG. 4, the brim 5 of the head covering comprised of an inner core 21 of closed-cell neoprene, rubber or like material sandwiched between water-resistant fabric material 20.

We claim:

1. A waterproof aquatic thermal head covering adapted to be worn on a user's head while in or on water and while engaged in sports and other aquatic activities, which comprises:

a) a cap conforming to the user's head curvature and formed of: a center panel of flexible laminated material extending from the front of said cap to the rear of said cap and consisting of an inner layer of closed-cell material and outer layers of water-resistant fabric material, and side panels of like flexible laminated material, said side panels at their edges being mated and bonded to the edges of said center panel, said center and side panels at their mated and bonded edges bearing edge-securing stitching, and said cap presenting at its lower edge portion an adjustable brim foldable upwardly along a circumferential fold line against the outer surface of said cap; and b) ear flaps affixed to the inside of the cap and extending downwardly therefrom on each side panel thereof proximate the fold line of the adjustable brim, said ear flaps including chin strap means bearing hook and loop fasteners for securing the cap to the user's head and for alternatively securing the chin strap means across the outer top portion of the cap.

2. A waterproof aquatic thermal head covering adapted to be worn on a user's head while in or on water and while engaged in sports and other aquatic activities as claimed in claim 1 wherein said cap at the rear thereof proximate the circumferential fold line of said adjustable brim is provided with a port for drainage of any water accumulated between said cap and said brim.

3. A waterproof aquatic thermal head covering adapted to be worn on a user's head while in or on water and while engaged in sports and other aquatic activities as claimed in claim 1 wherein said cap at the rear thereof proximate the circumferential fold line of said adjustable brim is provided with removable cord means for securing the head covering to the user's other apparel or a floatation device.

4. A waterproof aquatic thermal head covering adapted to be worn on a user's head while in or on water and while engaged in sports and other aquatic activities as claimed in claim 1 wherein said head covering has affixed thereto on the outer surface thereof patches of light reflective tape to provide long-range visibility of the head covering.

5. A waterproof aquatic thermal head covering adapted to be worn on a user's head while in or on water and while engaged in sports and other aquatic activities as claimed in claim 1 wherein the ear flaps each include an auditory portal positioned to interface an ear of the user of said head covering, said auditory portals being covered by water-resistant fabric material.

6. A waterproof aquatic thermal head covering adapted to be worn on a user's head while in or on water and while engaged in sports and other aquatic activities as claimed in claim 1 wherein the flexible laminated material of the cap of said head covering provides thermal protection to the user's head.

7. A waterproof aquatic thermal head covering adapted to be worn on a user's head while in or on water and while engaged in sports and other aquatic activities as claimed in claim 1 wherein said cap at the rear thereof proximate the circumferential fold line of said adjustable brim is provided with a port defined by a grommet extending through the flexible laminated material of said cap for drainage of any water accumulated between said cap and said brim when the brim is in its folded up position and wherein a removable cord is threaded through said grommet and knotted at each end thereof to provide means for securing the head covering to the user's apparel or a floatation device.

8. A waterproof aquatic thermal head covering adapted to be worn on a user's head while in or on water and while engaged in sports and other aquatic activities as claimed in claim 1 wherein the inner layer of closed-cell material of the flexible laminated material forming the center and side panels of the cap is selected from the group consisting of closed-cell neoprene and closed-cell rubber.

* * * * *